US008459364B2

(12) United States Patent
Solland

(10) Patent No.: US 8,459,364 B2
(45) Date of Patent: Jun. 11, 2013

(54) METHOD AND DEVICE FOR SECURING A WELL

(75) Inventor: Asmund Solland, Stavanger (NO)

(73) Assignee: Aker Well Service AS, Stavanger (NO)

( * ) Notice: Subject to any disclaimer, the term of this patent is extended or adjusted under 35 U.S.C. 154(b) by 147 days.

(21) Appl. No.: 12/613,327

(22) Filed: Nov. 5, 2009

(65) Prior Publication Data

US 2010/0108325 A1 May 6, 2010

(30) Foreign Application Priority Data

Nov. 6, 2008 (NO) ..... 20084683

(51) Int. Cl.
*E21B 34/14* (2006.01)

(52) U.S. Cl.
USPC ..... 166/373; 166/332.4

(58) Field of Classification Search
USPC ..... 166/373, 332.4, 386, 334.2
See application file for complete search history.

(56) References Cited

U.S. PATENT DOCUMENTS 4,230,185 A * 10/1980 Fredd ..... 166/332.3

FOREIGN PATENT DOCUMENTS

NO 316087 12/2003

* cited by examiner

*Primary Examiner* — David Andrews
(74) *Attorney, Agent, or Firm* — Finnegan, Henderson, Farabow, Garrett & Dunner, LLP

(57) ABSTRACT

A method and a device for securing a well during sluicing in of a well tool includes arranging a landing sleeve provided with a barrier valve in a well tubular downstream of a subsurface safety valve; displacing the well tool into the well tubular until a braking nose being connected to the well tool is placed in the landing sleeve; and unlocking the barrier valve by means of a key being positioned on the leading end portion of the well tool.

5 Claims, 5 Drawing Sheets

METHOD AND DEVICE FOR SECURING A WELL

This invention relates to a method for securing a well. More particularly it concerns a method for securing a well during sluicing in of a well tool where the method comprises:

arranging a landing sleeve provided with a barrier valve in a well tubular downstream of a subsurface safety valve; and displacing the well tool into the well tubular until a braking nose connected to the well tool is placed in the landing sleeve. The invention also comprises a device for performing the method.

On sluicing in of long tools, typically a perforating gun, in a well, the tool extends generally through the wellhead valves while the sluicing opening is still open. The subsurface safety valve constitutes during such operations the only barrier between the well and the atmosphere. Should the perforating gun be dropped during sluicing in, it may damage the subsurface safety valve, whereby a further barrier is lost.

It is known to install a further subsurface safety valve in the well below the main subsurface safety valve. This further valve constitutes a backup valve for the main subsurface safety valve. A further subsurface safety valve is vulnerable and may be damaged or opened by an object being dropped into the well at great speed.

Norwegian patent 316087 deals with a braking arrangement for a tool string, where a landing sleeve is provided in a well tubular downstream of the subsurface safety valve. The landing sleeve is sealed and anchored against the well tubular. The tool string is provided with a leading end portion lockingly connected to a braking nose wherein the braking nose fits complementary in the landing sleeve.

Following the braking nose being locked in the landing sleeve, the tool may be released from the braking nose whereby the tool may be displaced further through the braking nose, the subsurface safety valve and further into the well tubular. The landing sleeve may according to NO 316087 be provided with a flap-valve. This arrangement offers no assurance that two well barriers exist during sluicing in of the tool string, as falling objects may have opened the valves.

The object of the invention is to remedy or reduce at least one of the prior art drawbacks.

The object is achieved according to the invention by the features stated in the below description and in the following claims.

There is provided a method for securing a well during sluicing in of a well tool, wherein the method comprises:

arranging a landing sleeve provided with a barrier valve in a well tubular downstream of a subsurface safety valve; and displacing the well tool into the well tubular until a braking nose connected to the well tool is placed in the landing sleeve. The method is also characterised in that it further comprises unlocking the barrier valve by a key positioned on the leading end portion of the tool.

Assurance may thereby be made that the barrier valve is not opened unintentionally by such as a falling object. The below positioned subsurface safety valve is accordingly also intact. The two valves, the subsurface safety valve and the barrier valve thus constitute two separate barriers against overpressure in a well. Sluicing in of the well tool may therefore be carried out without violation of existing regulations for securing of wells.

Advantageously the well tool may be displaced through the barrier valve subsequent to the braking nose being depended on and locked to the landing sleeve. It is thereby achieved that the braking nose is not displaced unintentionally out from the landing sleeve while the well tool is running through the braking nose.

The method may comprise the key inflicting a compressive force to the barrier valve on a predetermined portion of the barrier valve.

The method may be performed by means of a device for securing a well during sluicing in of a well tool, wherein a barrier valve constitutes a part of a landing sleeve for a well tool, as the landing sleeve is anchored in a well tubular on the downstream side of a subsurface safety valve, and wherein the well tool is releasably connected to a braking nose, as the braking nose fits complementary in the landing sleeve, and wherein the device is characterised by the leading end portion of the well tool being provided with a key fitting complementary in an actuating device in the barrier valve.

The key may have a diameter smaller or equal to the actuating device locking dogs radial distance when the locking dogs are positioned in their respective ring grooves, and larger than the locking dogs radial distance when the locking dogs are positioned outside their respective ring grooves.

The locking dogs may be provided with a protrusion arranged to be able to prevent the locking dogs from releasing unintentionally.

A displaceable locking device may comprise a locking body, which by means of a cooperating trigger device is displaceable or pivotable to a released position by means of a pressure or torque acting against the trigger device.

The barrier valve may comprise more than one locking device to secure the barrier valve from unintentional opening.

A displaceable or pivotable latch may bar the locking body. Opening of the barrier valve by such as falling objects or fluid pressure acting on the whole of the barrier valve cross-sectional area may thereby be avoided.

A blow or a force against the barrier valve will thus not be able to bring the barrier valve to open.

In the special part of the description the mode of operation of the invention is explained with reference to a simplified ball valve. Other valves, such as a flap-valve or other known valves are applicable. According to the invention the valves are adapted to be at least releasable or actuateable by means of the key on the well tool, but at the same time prevented from unintentional opening.

The method and the device according to the invention provide a lockable barrier upstream of the subsurface safety valve. Elongated tools may thus be sluiced into wells wherein considerable overpressure is present. This overcomes a long felt problem wherein the alternative has been to secure the well additionally using a relatively costly weight fluid.

In the following is described an example of a preferred embodiment which is illustrated in the accompanying drawings, wherein.

Figure 1:
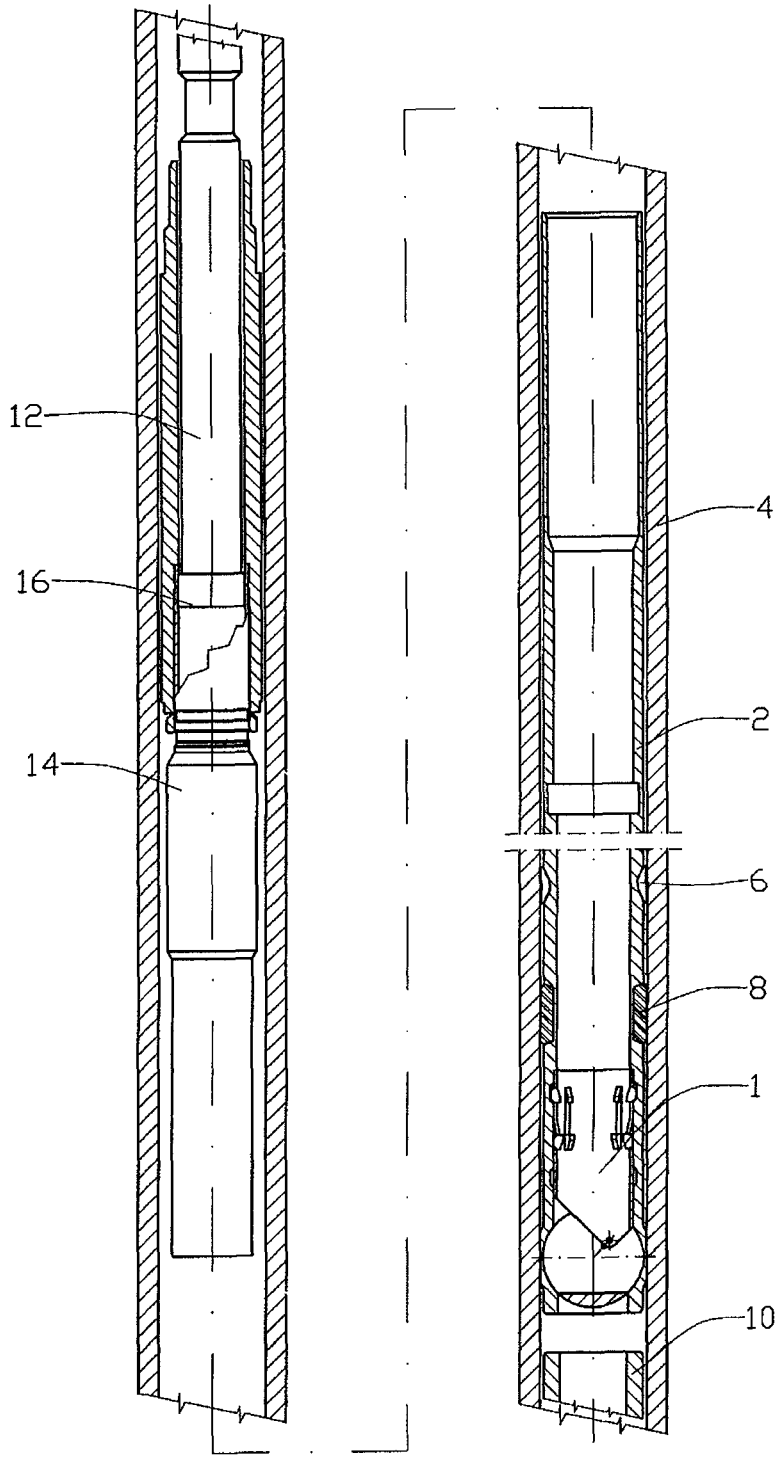
FIG. 1 shows a well tool fitted with a braking nose during displacement into a well tubular, as a landing sleeve connected to the well tubular is positioned downstream of a subsurface safety valve.
Figure 2:
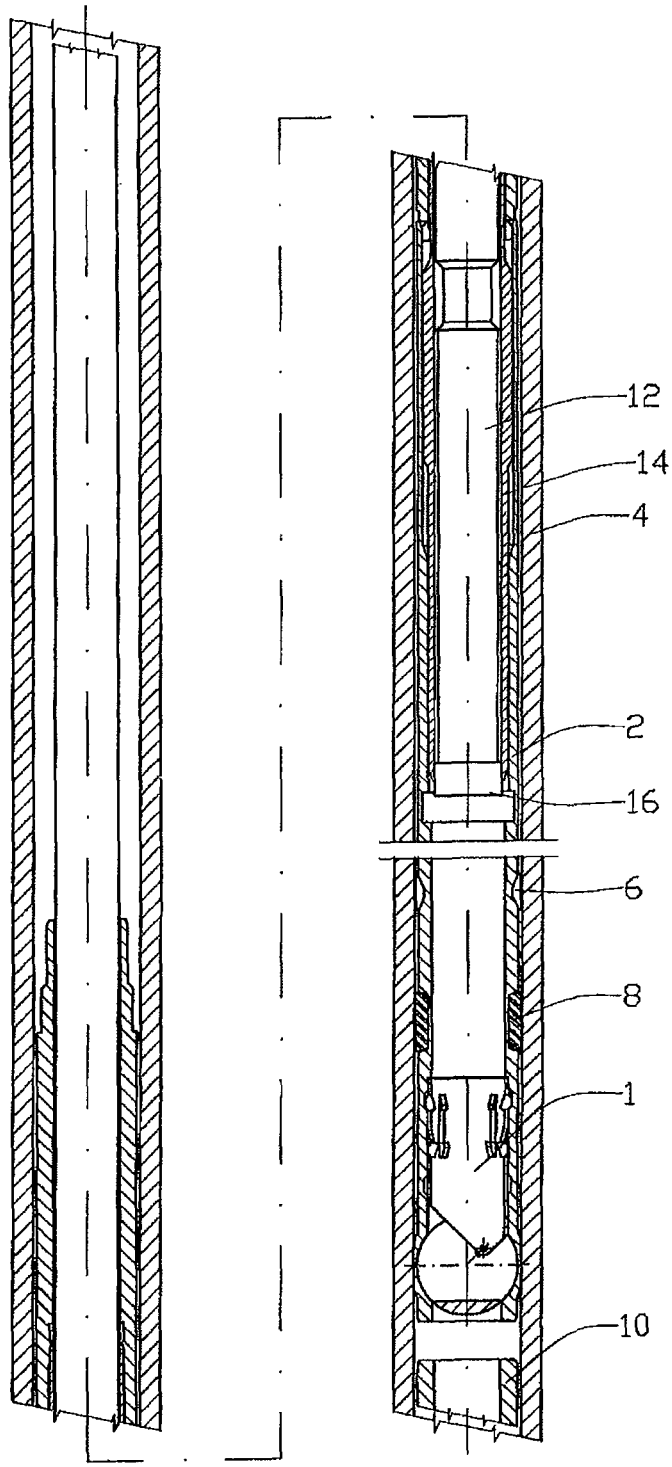
FIG. 2 shows the well tool subsequent to the braking nose being positioned in the landing sleeve.
Figure 3:
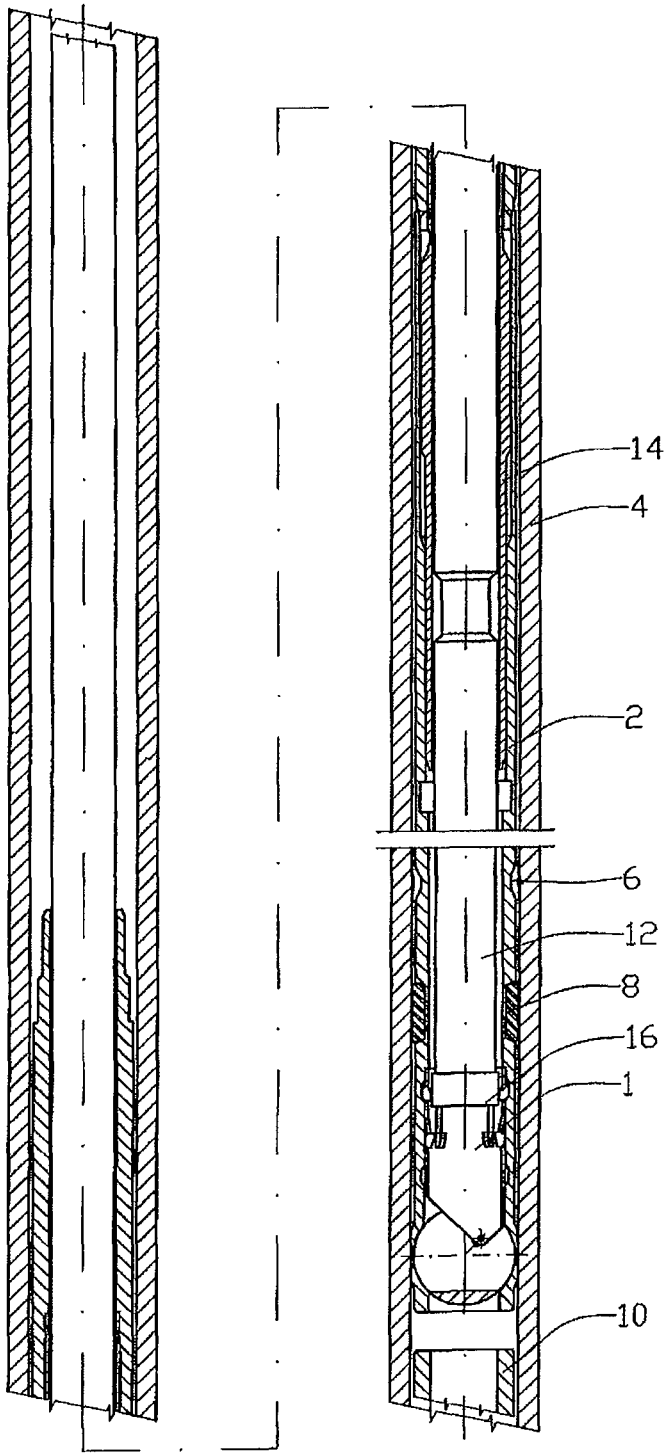
FIG. 3 shows the well tool subsequent to it being released from the braking nose and is embarking on coming into abutment against a barrier valve actuating device.

In the drawings the reference numeral 1 indicates a barrier valve positioned in a landing sleeve 2 in a well tubular 4. The landing sleeve 2 is in a per se known manner attached to the well tubular 4 by means of grippers 6 and sealed against the well tubular 4 by a packer 8. The landing sleeve 2 is positioned downstream of a subsurface safety valve 10.

A well tool 12 is provided with a releasable braking nose 14 fitting complementary inn the landing sleeve 2.

Figure 4:
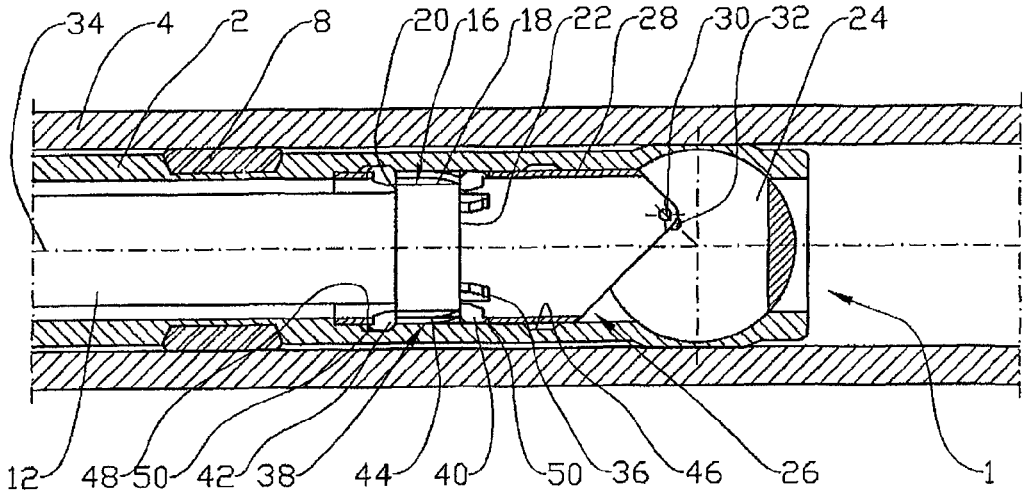
FIG. 4 shows in greater detail a principle sketch of the barrier valve, as the well tool key has unlocked the barrier valve actuating device.
Figure 5:
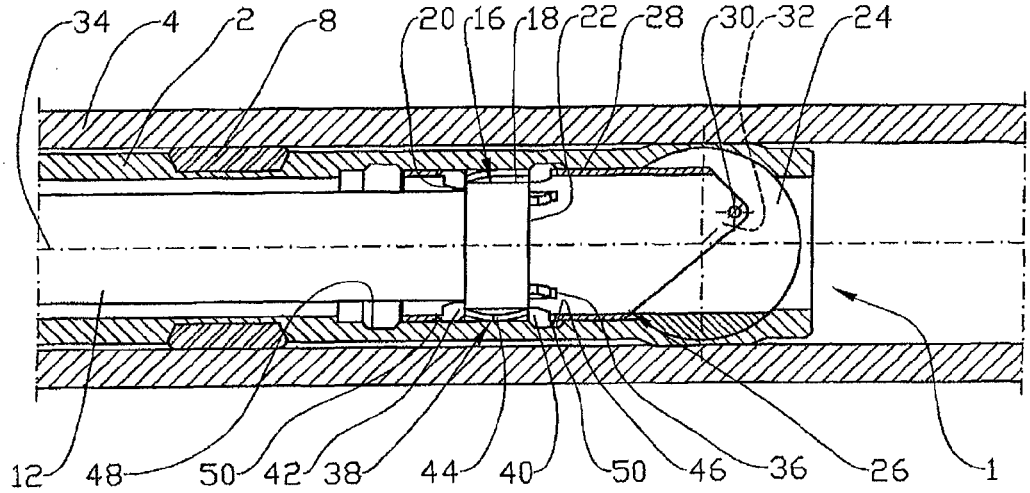
FIG. 5 shows the same as FIG. 4, but subsequent to the well tool opening the barrier valve.
Figure 6:
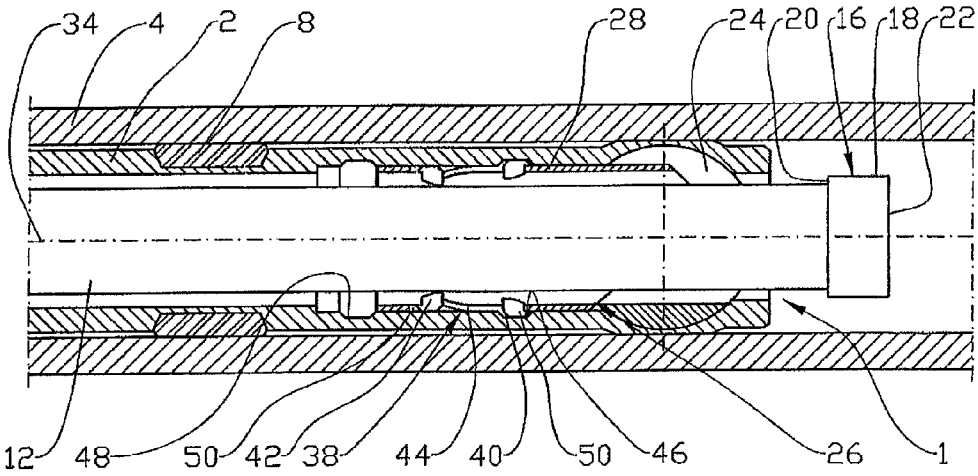
FIG. 6 shows the same as FIG. 4, but subsequent to the well tool being displaced into the barrier valve.

The well tool 12 leading end portion is designed with a key 16 in the form of a collar 18 having a shoulder 20 arranged at a certain distance from the free end surface 22 of the collar 18, see FIGS. 4-6.

The barrier valve 1 is provided with a sealing element, here in the form of a ball valve 24, see FIG. 4.

An actuating device 26 is arranged in the landing sleeve 2. The actuating device 26 comprises an axially displaceable actuating sleeve 28 in the landing sleeve 2. The actuating sleeve 28 is connected to the ball valve 24 by means of a pin 30 fitting complementary in a groove 32 in the ball valve 24.

The actuating sleeve 28 is designed with a number of axial openings 36 therethrough, equally distributed about the central axis 34 of the landing sleeve 2.

In each of the openings 36 is arranged a latch 38, as each latch 38 is limited axially displaceable in the actuating sleeve 28. Each latch 38 comprises a first locking dog 40 and a second locking dog 42 wherein the locking dogs are interconnected by means of a spring 44.

The first locking dog 40 is arranged to be able to be displaced radially into a first ring groove 46 in the landing sleeve 2. The second locking dog 42 is likewise arranged to be able to be displaced radially into a second ring groove 48 in the landing sleeve 2.

The collar 18 of the key 16 may only pass the locking dogs 40, 42 if these are in their respective ring grooves 46, 48.

The locking dogs 40, 42 are designed with a protrusion 50 arranged to be able to be displaced axially in behind the actuating sleeve 28 when the locking dogs 40, 42 are positioned in their respective ring grooves 46, 48.

When a well tool 12 is to be sluiced into the well tubular 4, the releasable braking nose 14 sees to that the well tool 12, in case it should be dropped, does not fall with too great speed, and is subsequently braked in the landing sleeve 2. Reference is made to NO 316087 wherein, among other things, the operating mode of the braking nose 14 is explained.

After the braking nose 14 is positioned in the landing sleeve 2, the well tool 12, now being released from the braking nose, is displaced further until the key 16 abuts the actuating device 24, see FIG. 4. In FIG. 4 the collar 18 has passed the second locking dogs 42 which are positioned in the second ring groove 48.

The collar 18 is now in abutment against the first locking dogs 40 and has displaced the latch 38 somewhat relative to the actuating sleeve 28 such that the protrusions 50 on the second locking dogs 42 are freed. The second locking dogs 42 are thereby free to be displaced radially in behind the shoulder 20 on the key 16.

During further displacement of the well tool 12 in a direction toward the ball valve 24, the actuating sleeve 28 together with the latches 38 are displaced axially in the landing sleeve 2 at the same time as the ball valve 24 is opened, see FIG. 5.

When the ball valve 24 is open, the first locking dogs 40 correspond with the first ring groove 46. The first locking dogs 40 are displaced radially into the first ring groove 46 and somewhat further in the axial direction relative to the actuating sleeve 28 such that the protrusions 50 on the first locking dogs 40 locks in behind the actuating sleeve 28. The first locking dogs 40 are thereby prevented from being able to be displaced radially outward from the first ring groove 46.

The collar 18 may now be displaced past the first locking dogs 40 and then on through the ball valve 24, see FIG. 6.

When the well tool is to be pulled out, the release, closing and locking of the barrier valve 1 takes place in the same way as described above, but in the reverse order.

It is emphasized that the drawings are principle sketches and that such as necessary fastening elements and preloading springs that will be well known to a person skilled in the art, are not shown.

The invention claimed is:

1. A method for securely sluicing in a well tool in a well tubular, wherein the method comprises:

arranging a landing sleeve provided with a barrier valve sealed and anchored against and within the well tubular downstream of a subsurface safety valve;

displacing the well tool into the well tubular until a braking nose being connected to the well tool is placed in the landing sleeve;

unlocking the barrier valve by means of a key being positioned on a leading end portion of the well tool wherein the key abuts one or more first locking dogs of a plurality of latches positioned in axial openings in an axially displaceable actuating sleeve, and the key axially displaces the latches and the actuating sleeve towards the barrier valve;

axially displacing the leading end portion of the well tool past the first locking dogs by increasing the radial distance between two diametrically opposite first locking dogs such that the radial distance is larger than the diameter of the key by axially displacing the latches towards the barrier valve until the first locking dogs are displaced radially outwards into a first ring groove in the landing sleeve; and displacing the well tool upstream past the barrier valve.

2. The method according to claim 1, further comprising:

a method for securely sluicing out a well tool in a well tubular after the well tool has been displaced upstream past the barrier valve, wherein the method for securely sluicing out comprises:

displacing the well tool which is positioned upstream the barrier valve past the barrier valve such that it is positioned downstream the barrier valve;

locking the barrier valve by means of a shoulder on a collar of the key, the shoulder abutting one or more second locking dogs of the plurality of latches, and the key axially displacing the latches and the actuating sleeve away from the barrier valve; and axially displacing the leading end portion of the well tool past the second locking dogs by increasing the radial distance between two diametrically opposite second locking dogs such that the radial distance is larger than the diameter of the key by axially displacing the latches away from the barrier valve until the second locking dogs are displaced radially outwards into a second ring groove in the landing sleeve.

3. A device for securing a well during sluicing in of a well tool, comprising:

a landing sleeve comprising a packer and a gripper with a barrier valve having an actuator device, wherein the landing sleeve is anchored in a well tubular on a downstream side of a subsurface safety valve; and a braking nose releasably connected to the well tool, wherein the braking nose fits in the landing sleeve, and the well tool at its leading end portion is provided with a key fitting complementary in the actuator device in the barrier valve, wherein the actuator device comprises a displaceable actuating sleeve, the displaceable actuating sleeve comprises a plurality of axial openings distributed about a central axis of the landing sleeve, the plurality of axial openings each house an axially displaceable latch comprising a first locking dog at one end of the latch facing the barrier valve and at an opposite end of the latch a second locking dog, wherein the locking dogs are interconnected by means of a spring, and the landing sleeve comprises a first ring groove and a second ring groove, each arranged to house radially displaceable first locking dog and second locking dog, respectively, such that the radial distance between two diametrically opposite first locking dogs is larger than the diameter of the key when the first locking dogs are positioned in the first ring groove and the radial distance between two diametrically opposite first locking dogs is smaller than the diameter of the key when the first locking dogs are positioned outside the first ring groove, and such that the radial distance between two diametrically opposite second locking dogs is larger than the diameter of the key when the second locking dogs are positioned in the second ring groove and that the radial distance between two diametrically opposite first locking dogs is smaller than the diameter of the key when the second locking dogs are positioned outside the second ring groove.

4. The device according to claim 3, characterized in that the first and second locking dogs are each provided with an axial directed protrusion.

5. A method for securely sluicing out a well tool in a well tubular, wherein the method comprises:

displacing the well tool which is positioned upstream a barrier valve past the barrier valve such that it is positioned downstream the barrier valve;

locking the barrier valve by means of a shoulder on a collar of a key, wherein the shoulder abuts one or more second locking dogs of a plurality of latches positioned in axial openings in an axially displaceable actuating sleeve, and the key axially displaces the latches and the actuating sleeve away from the barrier valve; and axially displacing a leading end portion of the well tool past the second locking dogs by increasing the radial distance between two diametrically opposite second locking dogs such that the radial distance is larger than the diameter of the key by axially displacing the latches away from the barrier valve until the second locking dogs are displaced radially outwards into a second ring groove in the landing sleeve.

* * * * *